US011091985B1

(12) United States Patent
Fontenot

(10) Patent No.: US 11,091,985 B1
(45) Date of Patent: Aug. 17, 2021

(54) MULTILATERAL DEFLECTION SYSTEM

(71) Applicant: Ernest J Fontenot, Spring, TX (US)

(72) Inventor: Ernest J Fontenot, Spring, TX (US)

( * ) Notice: Subject to any disclaimer, the term of this patent is extended or adjusted under 35 U.S.C. 154(b) by 0 days.

(21) Appl. No.: 16/578,551

(22) Filed: Sep. 23, 2019

Related U.S. Application Data

(60) Provisional application No. 62/860,592, filed on Jun. 12, 2019.

(51) Int. Cl.
*E21B 7/06* (2006.01)
*E21B 41/00* (2006.01)
*E21B 23/12* (2006.01)

(52) U.S. Cl.
CPC ..... *E21B 41/0042* (2013.01); *E21B 7/061* (2013.01); *E21B 23/12* (2020.05)

(58) Field of Classification Search
CPC .. E21B 41/0035; E21B 41/0042; E21B 7/061; E21B 23/12
See application file for complete search history.

(56) References Cited

U.S. PATENT DOCUMENTS 5,318,121 A * 6/1994 Brockman ..... E21B 7/061 166/313
9,416,638 B2 * 8/2016 Zhou ..... E21B 34/10
2015/0285016 A1 * 10/2015 Lajesic ..... E21B 23/12 166/381
2020/0149363 A1 * 5/2020 Cho ..... E21B 23/006

* cited by examiner

*Primary Examiner* — Brad Harcourt
(74) *Attorney, Agent, or Firm* — Plager Schack LLP; Mark H. PLager; Michael J. O'Brien

(57) ABSTRACT

A multilateral deflection system is configured to exit a main bore and enter an offset lateral. The multilateral deflection system includes a hole arranged in a ground surface having a main bore and an offset lateral. A latch in coupling is arranged in the main bore. A deflector assembly further includes a deflector body joined to deflector rails and deflector threads. A latch in sub is made up to the deflector body. A deflector profile is arranged in the main bore. A seal assembly is joined to a bottom side of the deflector body.

3 Claims, 3 Drawing Sheets

MULTILATERAL DEFLECTION SYSTEM

RELATED APPLICATION

This application claims priority to provisional patent application U.S. Ser. No. 62/860,592 filed on Jun. 12, 2019, the entire contents of which is herein incorporated by reference.

BACKGROUND

The embodiments herein relate generally to drilling equipment.

Lateral wellbores are frequently made by using a whipstock to redirect a bit to come through a casing wall and then continuing to drill and later complete one or more laterals. The mill or drill makes an elongated opening in the casing wall of the main bore through which production tubing is extended after the lateral is completed.

In low pressure environments, like drilling for communications equipment. This technology works well. However, when pumping materials at high pressure various systems were needed for reentry wells and for new wells. Embodiments of the disclosed system can be used in high pressure systems in either scenario.

SUMMARY

A multilateral deflection system is configured to exit a main bore and enter an offset lateral. The multilateral deflection system includes a hole arranged in a ground surface having a main bore and an offset lateral. A latch in coupling is arranged in the main bore. A deflector assembly further includes a deflector body joined to deflector rails and deflector threads. A latch in sub is made up to the deflector body. A deflector profile is arranged in the main bore. A seal assembly is joined to a bottom side of the deflector body.

In a first mode of operation, the deflector profile passes through the deflector body engaging with the deflector rails deflecting the deflector assembly from the main bore into the lateral offset.

In a second mode of operation, the deflector profile passes by the deflector rails, passes by the lateral offset, and continues down the main bore.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
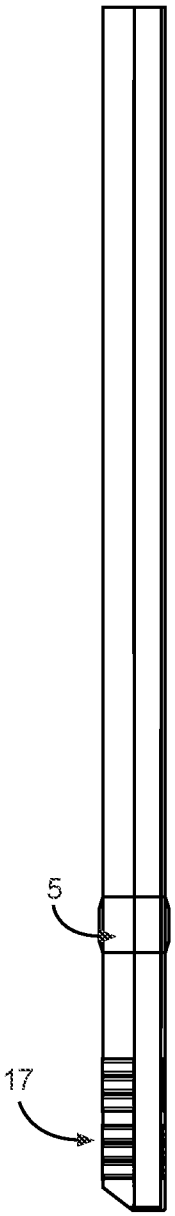
FIG. 1 shows a side view of one embodiment of the present invention.
Figure 2:
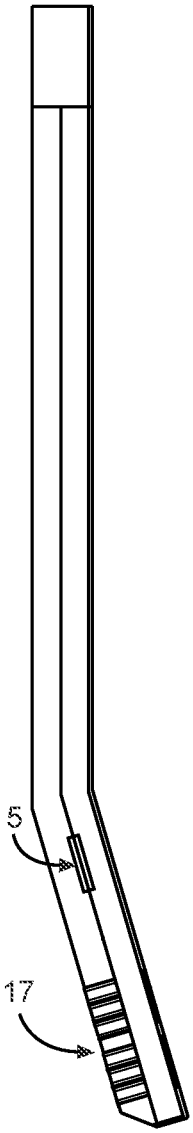
FIG. 2 shows a side view of one embodiment of the present invention.
Figure 3:
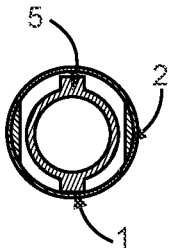
FIG. 3 shows a top cross-section view of one embodiment of the present invention.
Figure 4:
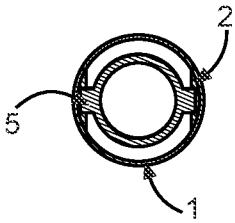
FIG. 4 shows a top cross-section view of one embodiment of the present invention.

By way of example, and referring to FIGS. 1-4, a multilateral deflection system is configured to exit a main bore and enter an offset lateral. The multilateral deflection system includes a hole arranged in a ground surface having a main bore and an offset lateral. A latch in coupling 10 is arranged in the main bore. A deflector assembly further includes a deflector body 1 joined to deflector rails 2 and deflector threads 4. A latch in sub 11 is made up to the deflector body 1. A deflector profile 5 is arranged in the main bore. A seal assembly 17 is joined to a bottom side of the deflector body 1.

In a first mode of operation, the deflector profile 5 passes through the deflector body 1 engaging with the deflector rails 2 deflecting the deflector assembly from the main bore into the lateral offset.

In a second mode of operation, the deflector profile 5 passes by the deflector rails 2, passes by the lateral offset, and continues down the main bore.

Figure 5:
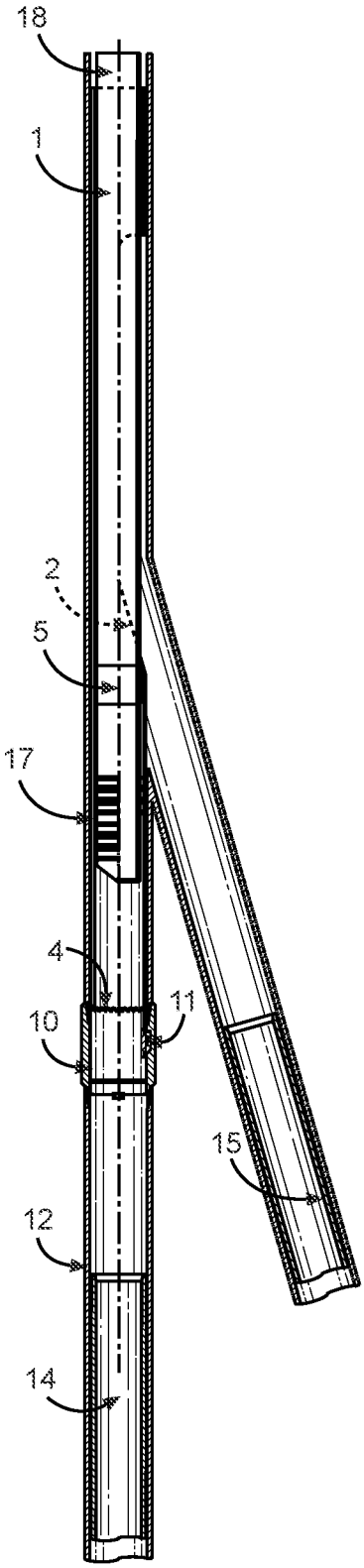
FIG. 5 shows a cross-section view of one embodiment of the present invention.

Turning to FIG. 5, to build the multilateral deflection system a user can perform a space out calculation to determine a placement of the latch in coupling 10. Once completed, the casing 12 is run to the specified depth where the latch in coupling 10 and the main bore polish bore receptacle 14 are made up between two joints in casing 12. A remaining portion of the casing 12 is run to the proposed depth and cemented in place as an operator specifies.

Figure 6:
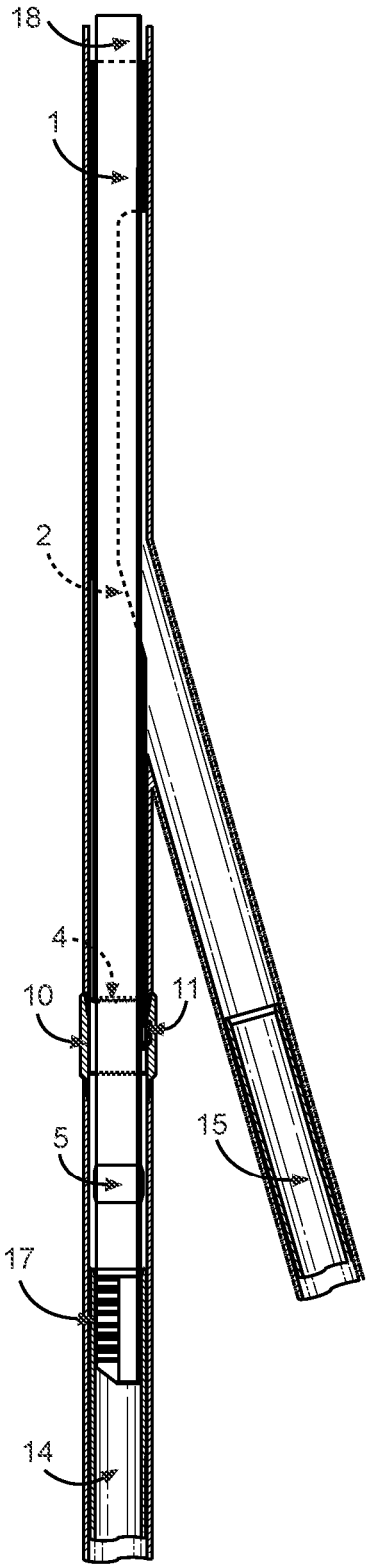
FIG. 6 shows a cross-section view of one embodiment of the present invention.

Turning to FIG. 6, the latch in sub 11 is made up and scribed to the universal bottom hole orientation (UBHO) and conveyed downhole on drill pipe past the latch in coupling 10. Pumps are engaged, and a work string 18 is pulled up until the latch in sub 11 orientates and latches into the latch in coupling 10. This identifies an orientation of the latch in coupling 10 and should be recorded. The work string 18 is pulled out of the main bore and set aside.

Figure 7:
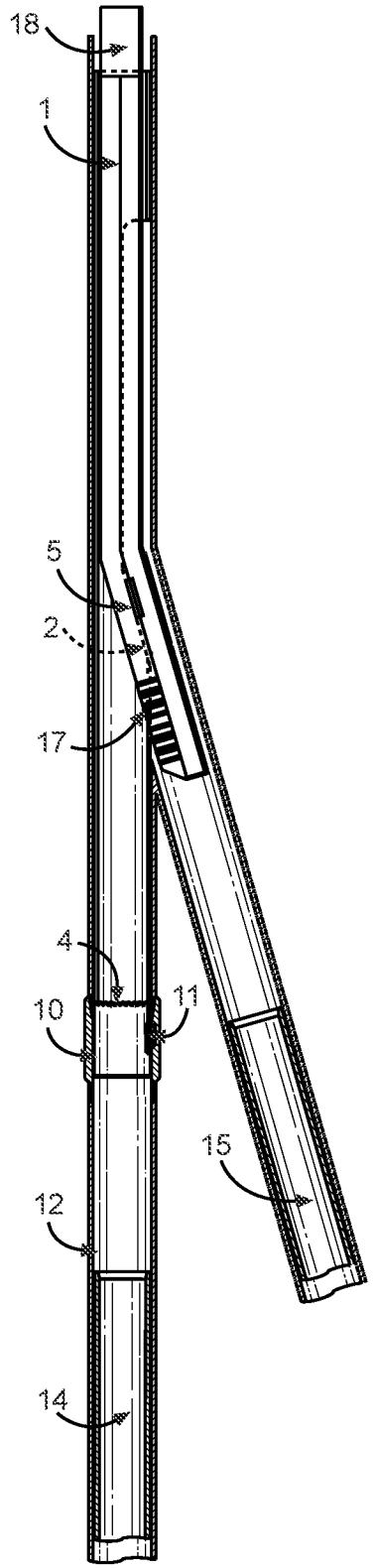
FIG. 7 shows a cross-section view of one embodiment of the present invention.
Figure 8:
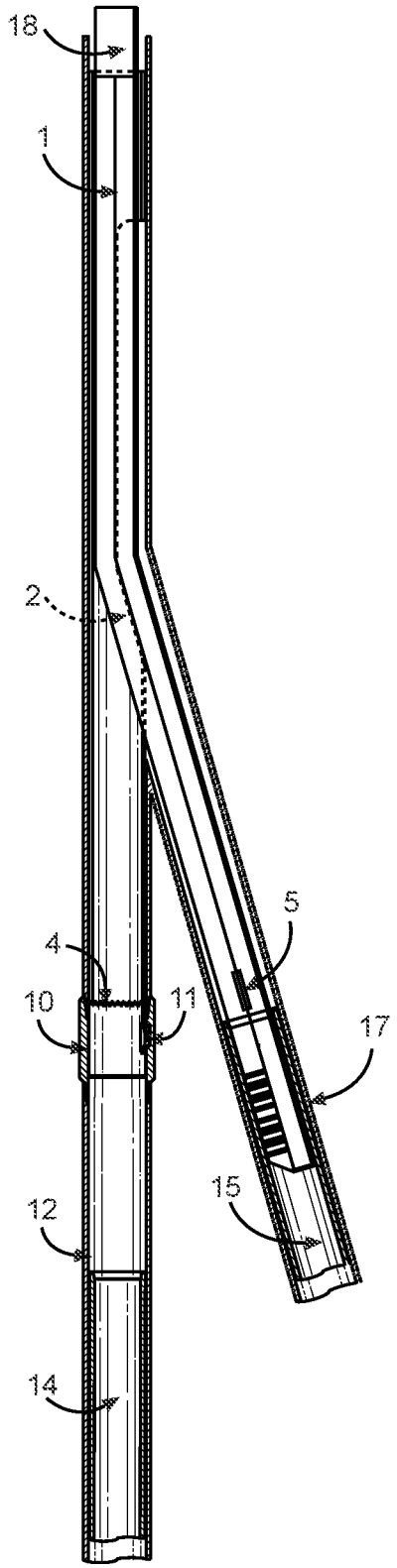
FIG. 8 shows a cross-section view of one embodiment of the present invention.

Turning to FIG. 7, the latch in sub 11 is made up to the bottom of the whipstock and orientated to the whipstock face. A whipstock assembly 6 includes mills, whipstock and a latch in sub 11 that are run in the wellbore past the latch in coupling 10 and then pulled up until the latch in sub 11 orientates and latches into the latch in coupling 10. A window is milled in the casing 12, and then the mills are pulled out of the hole. After this, a lateral is drilled as the operator specifies. Then, drilling tools are pulled out of the wellbore.

The production liner 13 is made up as the operator specifies and is run in the wellbore. The lateral polish bore receptacle 15 is made up to the top of the production liner 13 and run in the wellbore on a drill pipe. Once the lateral polish bore receptacle 15 is at the required setting depth, the running tool is released. The lateral polish bore receptacle 15 and the production liner 13 are left in the hole.

A whipstock retrieval tool is made up and conveyed on drill pipe above the whipstock 6. The whipstock retrieval tool is latched onto the whipstock 6, and, together with the latch in sub 11, are removed from the wellbore.

A deflector comprises the deflector body 1, deflector rails 2, and a deflector profile 5 that are made up to a latch in sub 11. The deflector is made up to a running tool and run in the wellbore past the latch in coupling 10 located in the main bore. The work string 18 is pulled upward until the latch in sub 11 is self-orientated and latches into place. The running tool is released and pulled out of the wellbore.

The seal assembly 17 is made up to the bottom of the deflector profile 5 which is then made up to the work string 18. Enough flush joint should be included in the work string 18 to allow the seal assembly 17 to pass through the deflector and enter the deepest polish bore receptacle. Once the seal assembly 17 is close to the top of the deflector, the running speed should be reduced and the top drive rotational break engaged. As the deflector profile 5 passes through the deflector body 1, the deflector profile 5 will either contact the deflector rails 2 causing the seal assembly 17, deflector profile 5 and the work string 18 to be deflected out of the main bore or the deflector profile 5 will miss the deflector rails 2 resulting in the seal assembly 17, deflector profile 5 and work string 18 to remain within the main bore. In the event, the deflector rails 2 are missed; this can be confirmed by not tagging the lateral polish bore receptacle 15 at the proper depth, the work string 18 should be marked and pulled out to a position above the deflector body 1. The work string 18 can be rotated a ¼ turn and lowered back through the deflector body 1 allowing the deflector profile 5 to contact and track down the deflector rails 2 and out of the main bore. Once the seal assembly 17 enters the lateral polish bore receptacle 15, the desired operation can commence. When the seal assembly 17 is required to reenter the main bore, the work string 18 can be pulled back above the deflector body 1.

As used in this application, the term "a" or "an" means "at least one" or "one or more."

As used in this application, the term "about" or "approximately" refers to a range of values within plus or minus 10% of the specified number.

As used in this application, the term "substantially" means that the actual value is within about 10% of the actual desired value, particularly within about 5% of the actual desired value and especially within about 1% of the actual desired value of any variable, element or limit set forth herein.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. § 112, ¶6. In particular, any use of "step of" in the claims is not intended to invoke the provision of 35 U.S.C. § 112, ¶6.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A multilateral deflection system is configured to exit a main bore and enter an offset lateral; the multilateral deflection system comprising:

a hole arranged in a ground surface having a main bore and an offset lateral;

a latch in coupling, arranged in the main bore;

a deflector assembly, further comprising:

a deflector body joined to deflector rails;

a latch in sub further comprising deflector threads, a deflector profile, arranged in the main bore and made up to a work string;

wherein rotating the work string engages the deflector rails with the deflector profile; and a seal assembly, joined to a bottom side of the deflector body.

2. The multilateral deflection system of claim 1, wherein the deflector profile passes through the deflector body engaging with the deflector rails deflecting the deflector assembly from the main bore into the lateral offset.

3. The multilateral deflection system of claim 1, wherein the deflector profile passes by the deflector rails, passes by the lateral offset, and continues down the main bore.

* * * * *